US005584607A

United States Patent [19]

de Baan

[11] Patent Number: 5,584,607

[45] Date of Patent: Dec. 17, 1996

[54] SINGLE POINT MOORING SYSTEM

[75] Inventor: Jacob de Baan, Maassluis, Netherlands

[73] Assignee: Bluewater Terminal Systems, Willemstad, Netherlands

[21] Appl. No.: 360,413

[22] Filed: Dec. 21, 1994

[30] Foreign Application Priority Data

Feb. 22, 1994 [BR] Brazil ..... 9400639

[51] Int. Cl.[6] ..... E02D 5/74; E02D 29/00

[52] U.S. Cl. ..... 405/224; 405/195.1

[58] Field of Search ..... 405/224, 223.1, 405/170, 171, 195.1; 251/315.01, 314

[56] References Cited

U.S. PATENT DOCUMENTS

| | | | |
|---|---|---|---|
| 3,425,663 | 2/1969 | Priese | 251/315.01 X |
| 4,023,773 | 5/1977 | Wise | 251/315.01 X |
| 4,254,523 | 3/1981 | Kentosh | 9/8 P |
| 4,448,266 | 5/1984 | Potts | 405/224 X |
| 4,597,350 | 7/1986 | Mott | 405/224 X |
| 4,702,321 | 10/1987 | Horton | 405/224 X |
| 4,797,033 | 1/1989 | Pollack | 405/224 X |

*Primary Examiner*—Tamara L. Graysay
*Assistant Examiner*—Tara L. Mayo
*Attorney, Agent, or Firm*—Deveau, Colton & Marquis

[57] ABSTRACT

A single point mooring system with at the bottom end thereof connecting points for risers which supply products from deep-water wells, said connecting points being arranged at the outer circumference of a bottom structure with enlarged diameter, each connecting point having a short vertical conduit and being arranged to guide therethrough a hookup wire in combination with a sealing element to be coupled to the upper end of a riser to hoist this end to the vertical conduit.

3 Claims, 6 Drawing Sheets

SINGLE POINT MOORING SYSTEM

Figure 1:
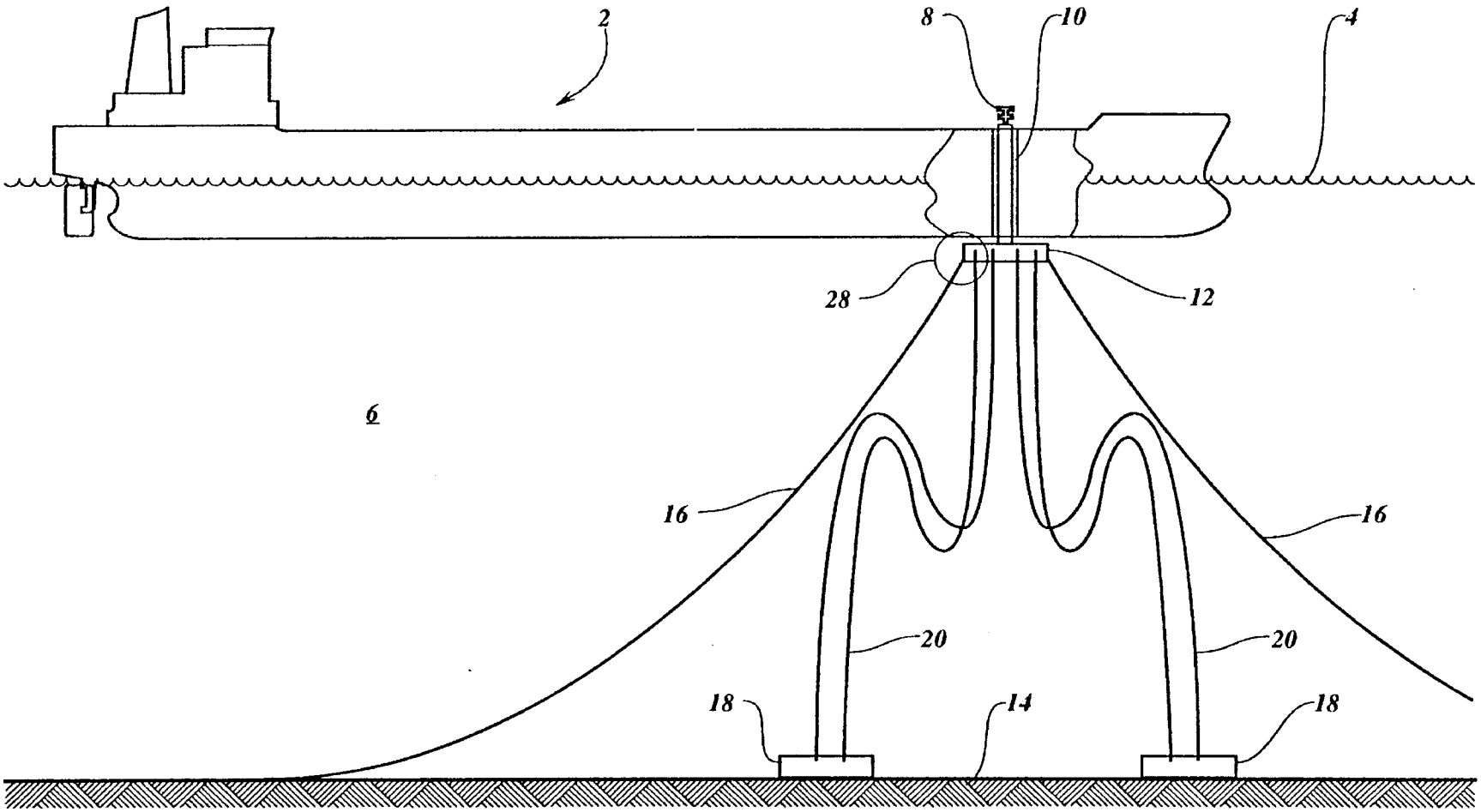

This invention relates to a single point mooring system, comprising a central part to be anchored to the seabed, enclosing at least one conduit and having at the bottom end connecting points for risers.

Increasingly, existing tankers are being employed as Floating Production and Offshore Storage (FPSO) systems. The aim of such tankers is to be connected by means of flexible risers to subsea oil production wellheads and receive and separate the well fluids into oil, water and gas. The oil is subsequently stored in the tanker's cargo tanks awaiting trans shipment to shore by the tanker itself or by a second tanker to which the cargo is transferred at the oil production site.

In most cases the production tankers are being moored by a Single Point Mooring (SPM) System of the kind as described above. Such system is well known in the industry and e.g. discussed in U.S. Pat. No. 4,254,523.

Due to the need to increase the efficiency of such systems, there is an increasing requirement to connect as many subsea wellheads as possible to the tanker.

Obviously the flexible risers, which provide the flow paths between the wellheads and the tanker deck (on which the oil water and gas separation plant is placed) have to be routed through the Single Point Mooring System, particulary through the area where the actual rotating weathervaning interfaces of such Single Point Mooring System are provided.

It is equally obvious that, if one increases the number of flexible risers, this also requires a larger rotating interface diameter.

As there is a need to provide a certain minimum spacing between adjacent risers for reasons of access and to prevent risers contacting each other in bad weather, the need to resort to large rotating interface diameters when employing say twenty or thirty risers becomes such that large costs are incurred in the fabrication and design of the Single Point Mooring System, particularly the rotating interface, i.e. the bearing system becomes a difficult and costly component.

These costs are mainly due to the overall size of the components and the need to machine these to strict tolerances. In addition to this the tanker structure to support these components becomes large and in some ships it even becomes impractical to incorporate such large diameter turrets.

Consequently there is a need to minimize the rotating interface diameter while still allowing a large space at the underside of the turret to pull in all risers at their preferred spacing. Also the hook-up and inspection of the upper riser termination flange without resorting to divers is preferred as it enhances safety and reduces operational costs.

It is the object of this invention to achieve this, and according to the invention this is obtained in that:

- the connecting points are arranged at at distance from the central part in the vicinity of the outer circumference of a structure with enlarged diameter, connected to said central part
- each connecting point continues into a short vertical conduit and is provided with means to close it against the ingress of surrounding water,
- each connecting point and conduit is arranged to guide there-through, starting from the upper end of the conduit, a hook-up wire in combination with a sealing element (so-called "lubricator"), the end of said wire is to be coupled to the upper end of a riser, and
- the upper end of each connecting point conduit is provided with a riser hang-off coupling, and conduit means are provided to connect an installed riser to a vertical conduit in the central part.

In a preferred embodiment the connecting point closure means comprises a ball-valve in the conduit thereof. However, a blind flange at the end of a connecting point may also be used.

The invention will be elucidated on the hand of the accompanying drawings. Herein shows:

FIG. 1 a general view of a tanker moored to a mooring system according to the invention.

Figure 2:
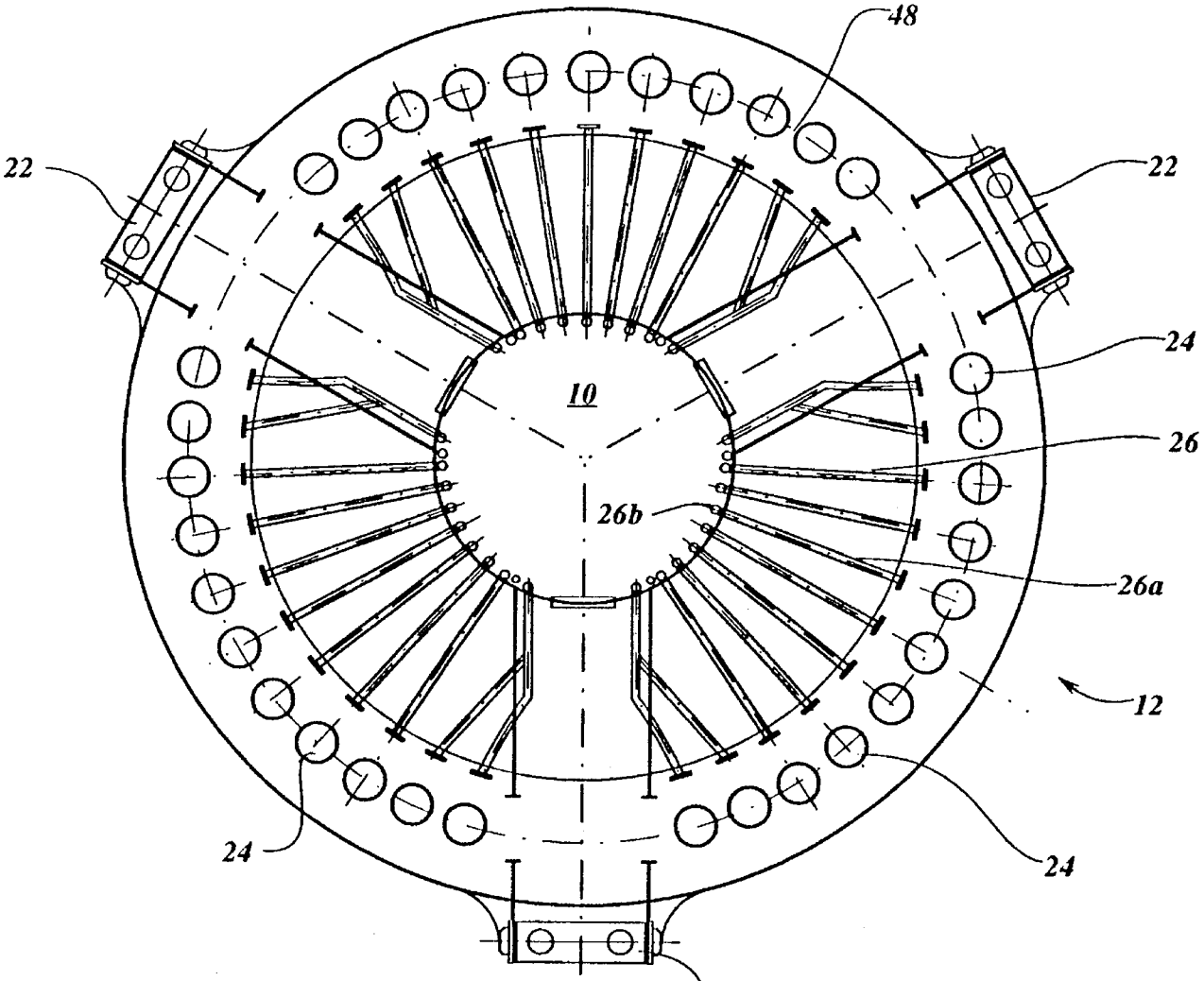
Figure 3:
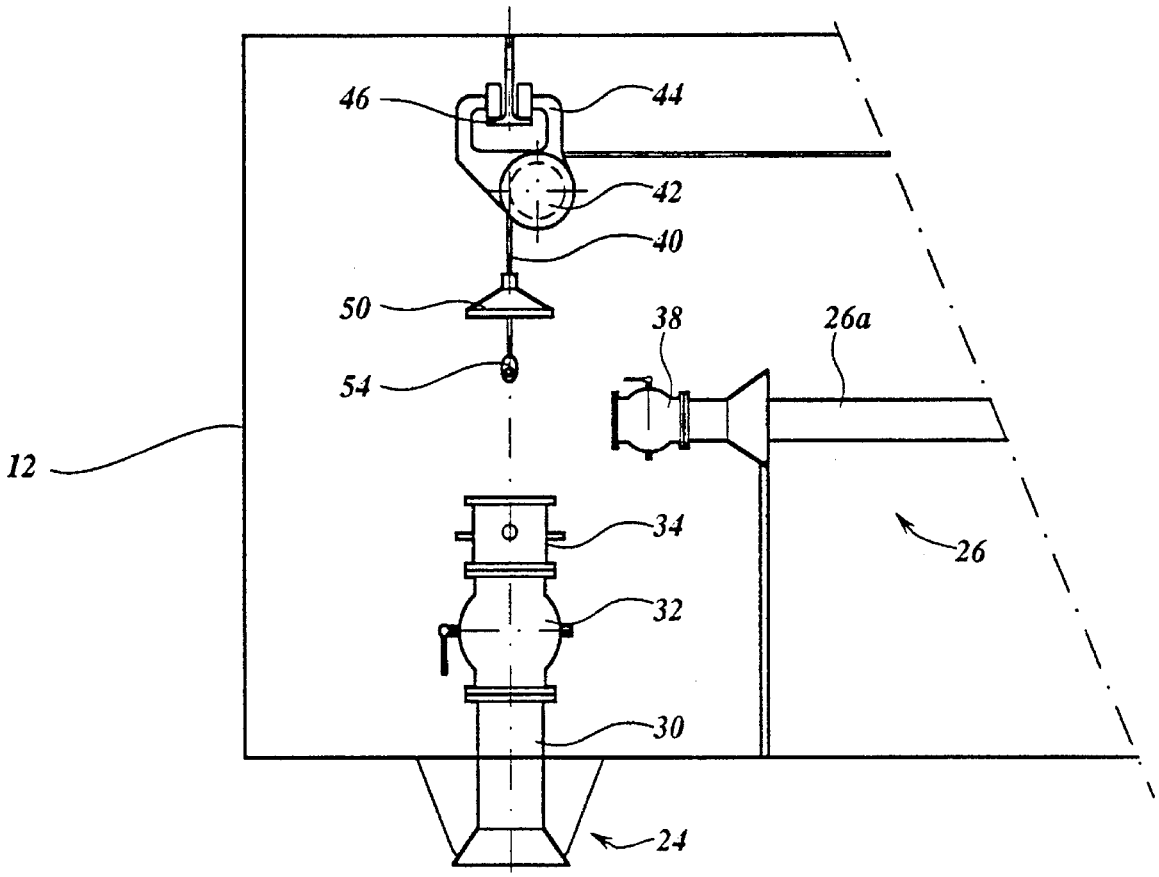
Figure 4:
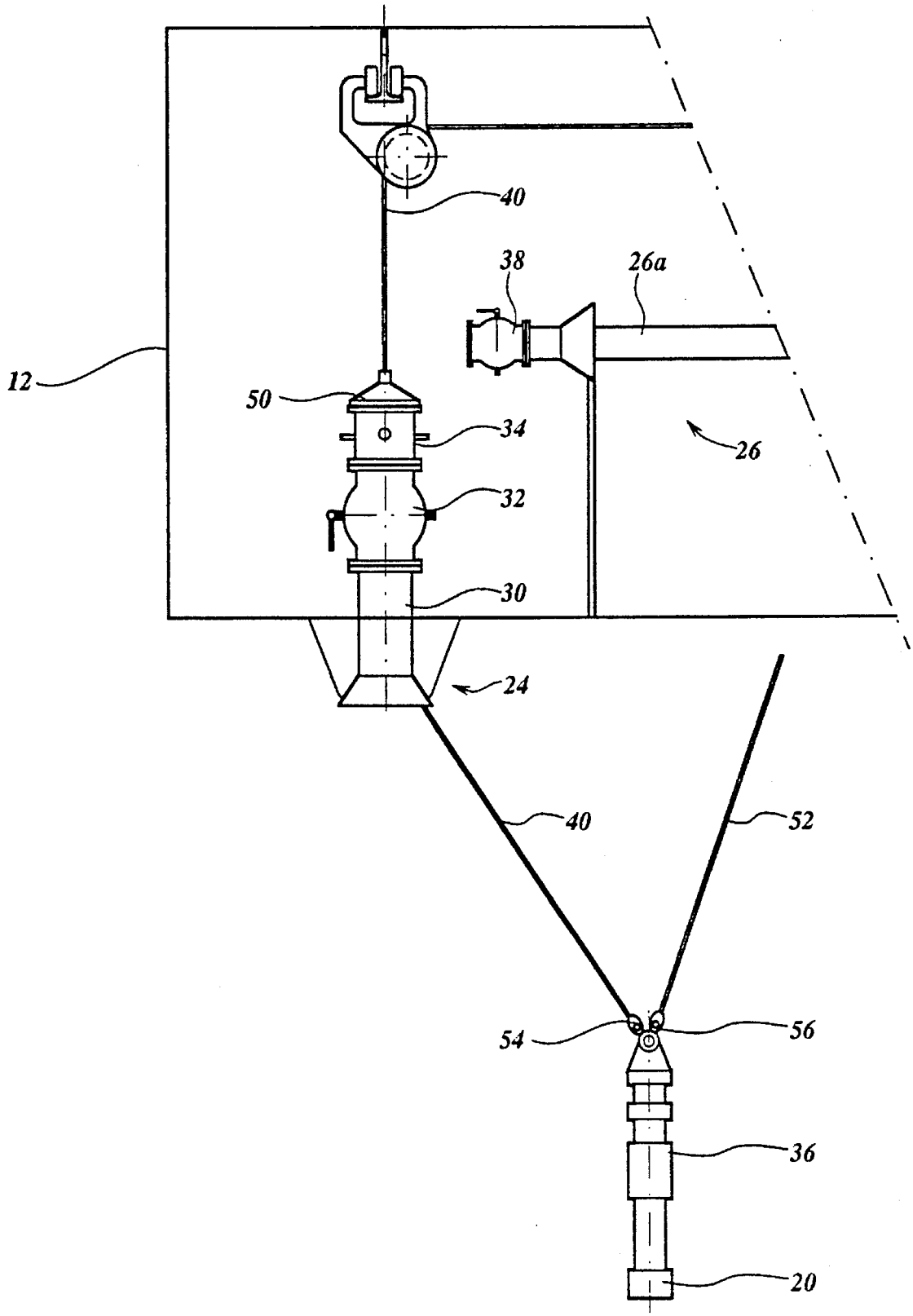
Figure 5:
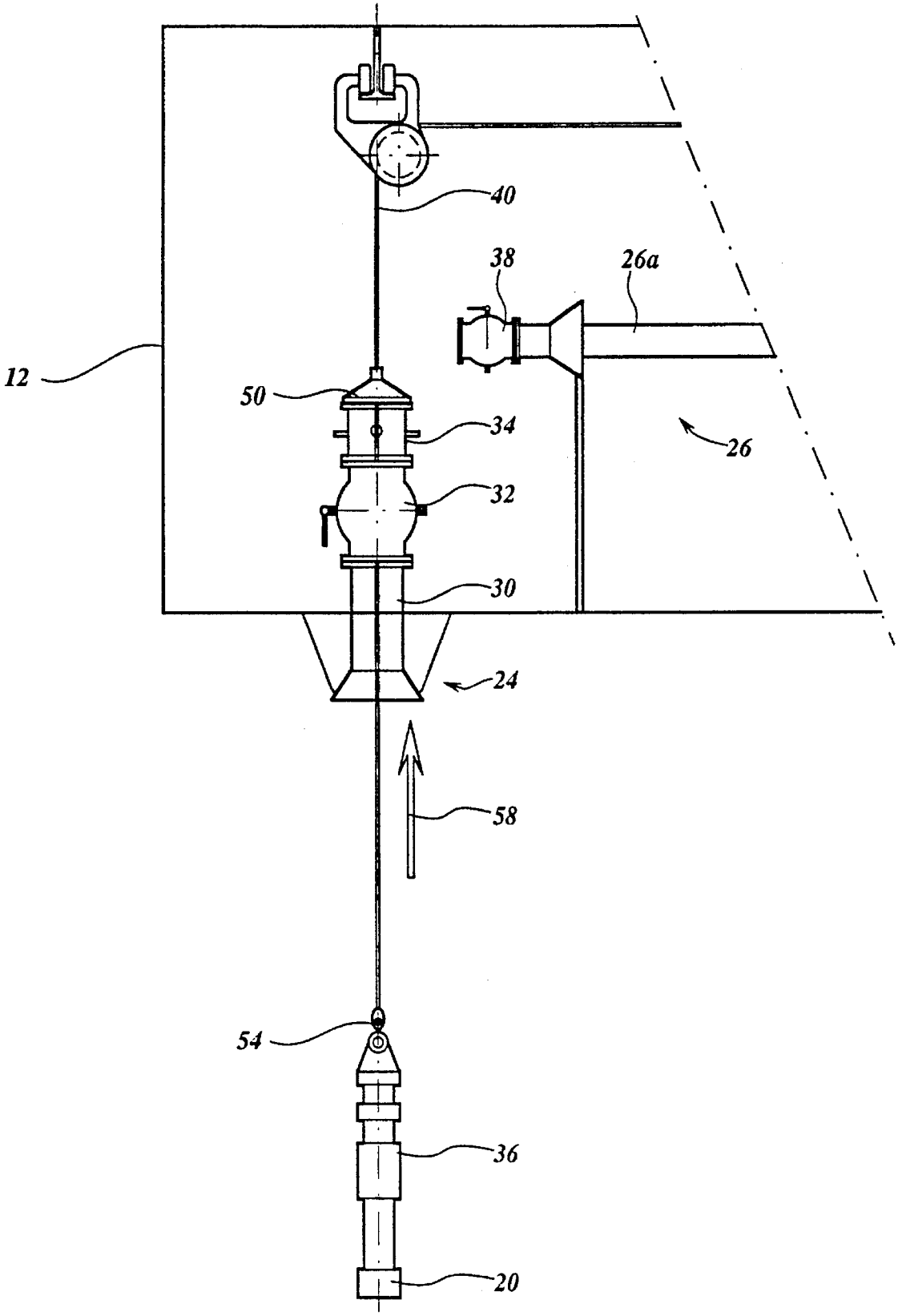
Figure 6:
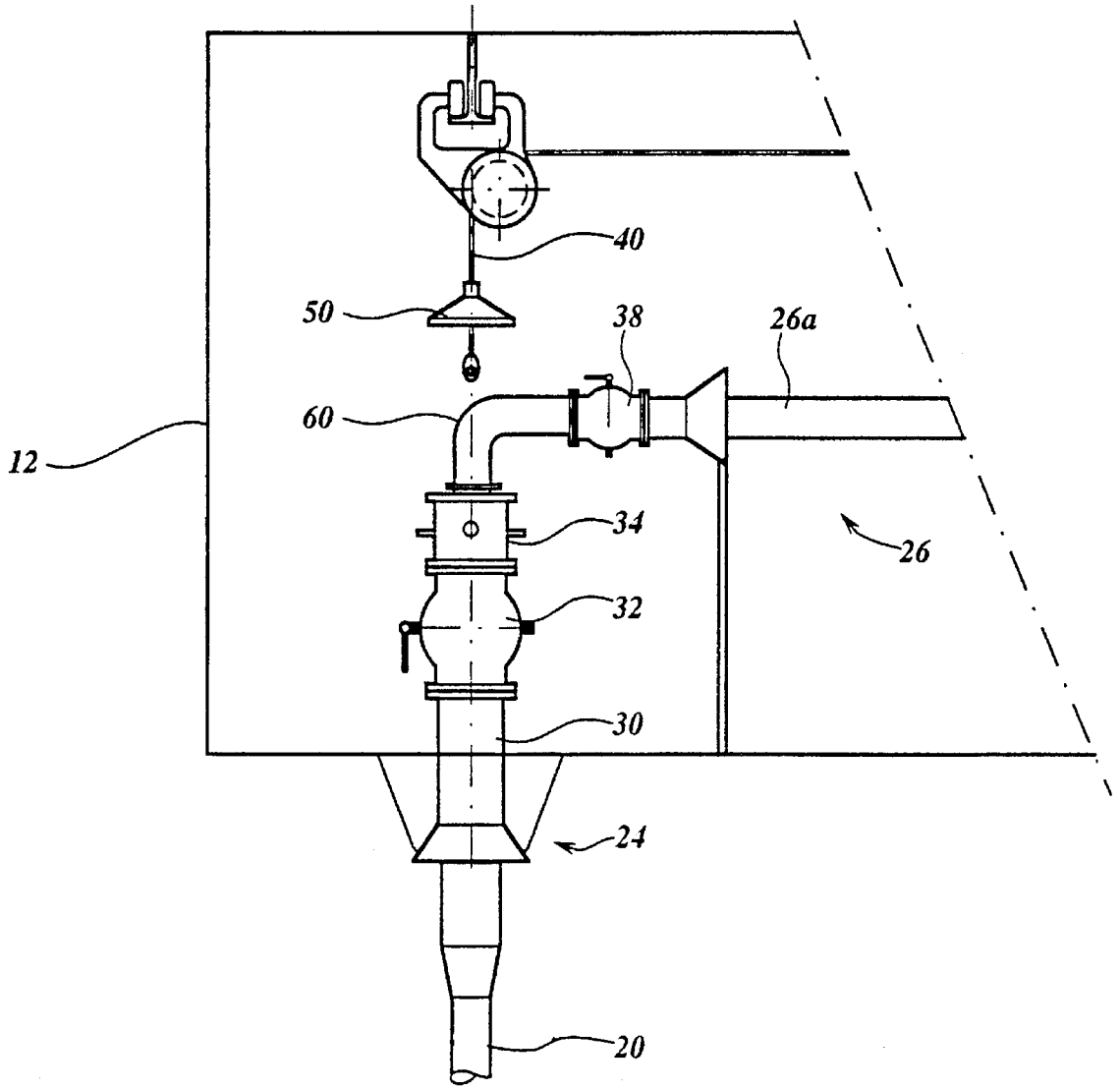

FIG. 2 a schematic bottom view of the bottom structure with enlarged diameter of this mooring system.

FIG. 3–6 schematic cross sections through the left hand part of the bottom structure, showing the various steps of hooking-up a riser.

In FIG. 2 reference numeral 2 denotes a large tanker, used as a floating production and offshore storage system floating on the surface 4 of a body of water 6. The mooring system is denoted generally with reference numeral 8; it comprises a central part 10, connected to a bottom structure 12 with a diameter which is considerably greater than the diameter of the central part 10. The mooring system is anchored to the seabed 14 by means of anchor chains 16. The interface between the conduits in this central part and the storage and production facilities on the tanker are not shown.

The tanker 2 is used to store and process the products which are delivered by the wellheads 18 via flexible risers 20. These risers are connected to the bottom structure 12 of the mooring system 8.

As explained herein before for economical reasons as many risers as possible are to be connected to the mooring system, yet they must have sufficient spacing. In the known mooring system this results in a central part 10 with a very large diameter, which is both uneconomical and costly, making it necessary to use interfaces with a large diameter. The unique structure proposed by the invention makes it possible to use a central part 10 with a relatively small diameter, yet to accommodate a great number of risers at sufficient mutual distances.

FIG. 2 shows a bottom view of the lower part 12 of the mooring system. This bottom part 12 comprises three anchor points 22, each to be connected to anchor chains 16 and has a number of riser connecting points, denoted with reference numeral 24. In the shown embodiment there are thirty-three connecting points and they are, as shown, arranged at a distance from the central part 10 and along the outer circumference of the structure 12. Each connecting point 24 can, in a manner to be described herein after, be connected to a conduit 26, consisting of a horizontal part **26*a* and a vertical part 26*b* which goes upwards through the central part 10**. In this way the products, supplied by the risers, are delivered to the tanker deck where they are to be subjected to the various necessary processing steps in a manner known in itself.

Of course in such a structure the problem arises as how to connect each riser to its connecting point and for this problem the invention provides a unique solution which is explained on the hand of the FIGS. 3–6.

These figures show cross sections to a left hand part of the bottom structure 12 and more specifically the part enclosed by the circle 28 in FIG. 1. The hollow bottom structure 12 and the central part 10 are dry, and must be kept so. Each connecting point 24 comprises a short lower conduit 30, a ball valve 32, and a short upper conduit 34. The inner diameter of the conduit 30 and 34 and the ball valve 32 in its open position are such that the upper part 36 of a riser 20, (vide FIGS. 4 and 5) can pass therethrough.

Including an angle with the conduits of the connecting point 24 is the discharge conduit 26 ending in a ball valve 38.

For connecting a connecting point 24 to a riser 20 there is an arrangement with a hook-up wire 40 which is to be connected to the upper end 36 of a riser 20 to bring the upper end 36 into the enlarged bottom structure 12 and thus make it accessible for coupling to a discharge conduit 26. This arrangement with the hook-up wire 40 comprises the guide roller 42; the wire is connected to suitable upwinding and unwinding or discharge means which are not shown. In the shown embodiment the roller 42 is supported by a U-shaped support 44 suspended on a circular guide rail 46 lying above the mid-points of the various connecting points 24, thus along the line 48 shown in FIG. 2. In this way the hook-up wire 40 can be placed above each connecting point to which a riser is to be connected. Other embodiments are, of course, possible.

Guided along the hook-up wire 40 is a sealing element 50 (in the state of the art called a "lubricator"), the function of which is to be explained hereinafter.

The hook-up sequence is now as follows:

In the first phase the wire 40 is lowered until the lubricator 50 closes-off the upper conduit 34 of the connecting point 24. Then the ball-valve 32 is opened and the wire 40 is guided therethrough and to the lower conduit 30.

A riser 20, to be connected to the connecting point 24, is guided by means of a guide wire 52 with a hook 56 to the vicinity of the connecting point 24 and the hook 54 at the end of the guide wire 40 is connected to the upper end 36 of the riser 20. Thereafter the hook 56 on the wire 52 is disconnected; the riser 20 now hangs vertically beneath the connecting point 24—vide FIG. 5. The riser 20 is now pulled upwardly in the direction of the arrow 58 and into the connecting point 24, thus through the conduits 30 and 34 and the ball-valve 32.

When the upper part 36 lies completely within the connecting point 24 it is locked and sealed thereto by means of non-shown locking means and the wire 40 is disconnected and pulled upwardly. Then an elbow-shaped conduit 60 is arranged between the termination flange of the riser 20 and the ball valve 38 of the discharge conduit 26; the ball valve 38 is opened and the product, supplied via the riser 20, can be delivered through the uprising conduit 26 in the central part 10 the deck of the tanker 2.

In an alternative arrangement the ball-cock 32 can be replaced by a blind flange at the bottom end of the conduit 30, although this calls for the services of a diver to disconnect this blind flange when a riser is to be hooked-up.

What is claimed is:

1. A single point mooring system, comprising a central part, a bottom structure, and at least one discharge conduit, said bottom structure comprising connecting points for risers, wherein the connecting points are arranged at a distance from the central part in the vicinity of the outer circumference of said bottom structure, each connecting point continuing into a lower conduit and being provided with closure means to prevent the ingress of surrounding water, said mooring system further comprising guide means for guiding the risers into connection with the connecting points, said guide means comprising a hookup wire extending through a sealing element, one end of said hookup wire comprising means for connecting to the upper end of a riser, the upper end of each lower conduit being provided with a coupling for engaging the riser, said mooring system further comprising connection means to connect an installed riser to said at least one discharge conduit.

2. A single point mooring system according to claim 1, in which the connecting point closure means comprises a ball-valve in the conduit thereof.

3. A single point mooring system according to claim 1, comprising a single discharge conduit in the central part.

* * * * *